US006612579B1

(12) United States Patent
Cembruch

(10) Patent No.: US 6,612,579 B1
(45) Date of Patent: Sep. 2, 2003

(54) METHOD AND SYSTEM FOR PLAYING DICE GAME

(76) Inventor: John Cembruch, 34 Egypt La., Clinton, CT (US) 06413

( * ) Notice: Subject to any disclaimer, the term of this patent is extended or adjusted under 35 U.S.C. 154(b) by 0 days.

(21) Appl. No.: 10/322,249

(22) Filed: Dec. 17, 2002

(51) Int. Cl.[7] ..... A63F 9/04
(52) U.S. Cl. ..... 273/274; 273/309; 273/146
(58) Field of Search ..... 273/146, 274, 273/292, 309; 463/10, 16

(56) References Cited

U.S. PATENT DOCUMENTS

| | | | | |
|---|---|---|---|---|
| 2,577,087 A | | 12/1951 | Meeks | |
| 4,334,685 A | | 6/1982 | Robbins et al. | |
| 4,688,803 A | | 8/1987 | Ollington | |
| 5,072,946 A | | 12/1991 | Miller | |
| 5,133,559 A | | 7/1992 | Page | |
| 5,362,064 A | * | 11/1994 | Lofink et al. | 273/292 |
| 5,413,351 A | | 5/1995 | Franklin | |
| 5,490,670 A | | 2/1996 | Hobert | |
| 5,605,331 A | | 2/1997 | Boe | |
| 5,718,431 A | | 2/1998 | Ornstein | |
| 6,113,492 A | | 9/2000 | Walker et al. | |
| 6,293,864 B1 | * | 9/2001 | Romero | 463/12 |
| 6,299,533 B1 | * | 10/2001 | Parra et al. | 463/17 |
| 6,319,122 B1 | | 11/2001 | Packes, Jr. et al. | |
| 6,336,862 B1 | | 1/2002 | Byrne | |
| 6,379,247 B1 | | 4/2002 | Walker et al. | |
| 6,435,505 B1 | * | 8/2002 | Hoffman | 273/274 |
| 2002/0010014 A1 | * | 1/2002 | Parra et al. | 463/17 |
| 2002/0096827 A1 | * | 7/2002 | Markowiak | 273/138.1 |

OTHER PUBLICATIONS

Scarne's New Complete Guide to Gambling by John Scarne, "Barbouth," 1961.

* cited by examiner

*Primary Examiner*—William M. Pierce
(74) *Attorney, Agent, or Firm*—DeLio & Peterson LLC; Peter W. Peterson

(57) ABSTRACT

A method of playing a dice game with a plurality of players comprises selecting a first shooter, and designating players into first and second groups. Players in the first group then bet money, in sequence, in favor of the first shooter winning, based on the dice throw, and players in the second group then bet, in sequence, against the first shooter winning. The first shooter rolls the dice, and the first shooter wins or loses based on a designated set of winning and a designated set of losing numbers. If the first shooter wins, the losing second group players' money is dispersed to the first player group in the sequence and based on the amount bet by each of the players in the first player group. If the first shooter loses, the losing first group players' money is dispersed to the second player group in a similar sequence.

23 Claims, 4 Drawing Sheets

METHOD AND SYSTEM FOR PLAYING DICE GAME

BACKGROUND OF THE INVENTION

1. Field of the Invention

The present invention relates to a method and system for playing a betting game having a jackpot, and more particularly, to a method of playing a game on a specified table having a pre-set betting and winning payoff sequence.

2. Description of Related Art

There are a number of casino-type dice and other games that permit betting on the basis of the generation of random numbers or other indicia. Such games include poker, craps twenty-one, and the like. Often, as in the case of the game of craps, there is a disadvantage as they are relatively complicated to play. Such complications discourage the novice player from participating, since the novice player typically feels awkward and intimidated by the level of skilled required to assess the probabilities of winning. In other games, the betting may be against the house, for example in the dice game in which a plurality of players bet against the house on the outcome of a three dice throw by the dealer. Since, the players do not bet against each other, some players may be intimidated by having to bet against the house.

Roulette, on the other hand, is relatively simple to understand and offers players the advantage of numerous combinations of wagers, with the player betting on black, white, odd, even, or individual numbers. However, roulette offers very little player interaction or participation, and for this reason is not as popular as it might be. Further, in all these games, the house or casino has an advantage in the odds of winning.

An old dice game called Barbouth permits the first and second shooters to bet against each other, and the first shooter may permit other bettors to cover the second shooter's bet if it exceeds the shooter's bet, and other bettors may make side bets with each other, all in no specified order. In this game there is no edge to the house in the odds of winning, however the house typically takes a charge of 2½% from each winning bet, and a bookmaker may take a 5% charge from each side bet, splitting it with the house. Nonetheless, this game lacks a convenient, simple and interesting structure for betting which provides interest and participation to non-shooting players.

Heretofore, the ability to inject the aura of a jackpot into conventional casino gaming methods and equipment has been highly limited. This result is at least in part because conventional gaming arrangements cannot be provided with the possibility of winning a jackpot without a major modification of the game arrangement, and changing the method and the rules by which the conventional game is played. A method and/or rule change to conventional casino games would be undesirable because traditional methods of gaming have wide appeal and are known to patrons.

An additional drawback of existing gaming methods is that jackpot arrangements which occur as a result of conditions which are not related to dice outcomes have always been somewhat suspect and not well received by the public. For example, a known gaming method includes the use of jackpot areas in the game of craps wherein the jackpot areas are defined by a geometric shape embossed on the craps table. A jackpot condition is attained when a die rebounds off the dice table wall and lands completely inside the geometric shape. The question arises as to whether the player rolling the dice is playing craps, or is rather attempting his skill at putting a die in the geometric shape. This destroys, or at least changes the atmosphere of the conventional game of craps being played. Also, the jackpot condition in this game lacks any additional wagering possibilities related to the various dice outcomes in the game of craps.

Players of games of skill and chance are constantly seeking games offering greater excitement and higher payoffs. In an attempt to make games more exciting, games have been invented utilizing different chance mediums, such as cards, rotating reels in slot machines, rotating wheels in roulette, or dice, or the like. Further, others have attempted to make existing games more exciting by allowing raising the stakes or providing a larger jackpot. For example, slot machines are often linked to one another, whereby the player of one machine who obtains a winning result receives a large jackpot based on the total play of the linked machines.

SUMMARY OF THE INVENTION

Bearing in mind the problems and deficiencies of the prior art, it is therefore an object of the present invention to provide a gaming method involving two primary players in which no player strategy affects the outcome of the game.

It is another object of the present invention to provide a gaming method where the bettor has multiple choices in betting on an outcome.

It is a yet another object of the present invention to provide a gaming method where the bettor has multiple ways of winning.

It is still another object of the present invention to provide a gaming method for randomly generating a jackpot sequence.

It is a further object of the present invention to provide a gaming method of prioritizing the betting by the players, and which leads to sequential and frequent betting.

It is still a further object of the present invention to provide a gaming method having even odds for all players.

Still other objects and advantages of the invention will in part be obvious and will in part be apparent from the specification.

The above and other objects, which will be apparent to those skilled in art, are achieved in the present invention which is directed to a method of playing a betting game with a plurality of players comprising providing a random symbol selector adapted to generate different symbols and designating sets of winning and losing symbols which may be generated by the random symbol selector. The method then includes selecting a first selector from the players, and designating players into first and second groups. Players in the first group then bet desired amounts of money, in sequence, in favor of the first selector winning, based on a symbol set generated by the random symbol selector. Players in the second group then bet desired amounts of money, in sequence, against the first selector winning based on a symbol set generated by the random symbol selector. The first selector generates a first symbol set using the random symbol selector. The method then includes determining whether the first selector wins or loses based on the first symbol set generated by the random symbol selector. A symbol set from the designated set of winning symbols indicates that the first selector wins and a symbol set from the designated set of losing symbols indicates that the first selector loses. If the first selector wins, the method includes dispersing to the first player group money bet by the second player group, with the money being dispersed to the first player group in the sequence and based on the amount bet by each of the players in the first player group. If the first selector loses, the method includes dispersing to the second player group money bet by the first player group, with the money being dispersed to the second player group in the sequence and based on the amount bet by each of the players in the second player group.

The method preferably includes designating a second selector from the players, such that the betting by the first group of players is that the first selector wins or the second selector loses, and the betting by the second group of players is that the second selector wins or the first selector loses. If the first selector neither wins nor loses based on the first symbol set generated by the random symbol selector, the method preferably further comprises generating a second symbol set, by the second selector, using the random symbol selector, and determining whether the second selector wins or loses based on the second symbol set generated by the random symbol selector. Again, a symbol set from the designated set of winning symbols indicating that the second selector wins and a symbol set from the designated set of losing symbols indicating that the second selector loses. If the second selector wins, the method includes dispersing to the second player group money bet by the first player group, with the money being dispersed to the second player group in the sequence and based on the amount bet by each of the players in the second player group. If the second selector loses, the method includes dispersing to the first player group money bet by the second player group, with the money being dispersed to the first player group in the sequence and based on the amount bet by each of the players in the first player group.

In the preferred method, if the first selector neither wins nor loses based on the first symbol set generated by the random symbol selector, and if the second selector neither wins nor loses based on the second symbol set generated by the random symbol selector, the method further comprises alternately generating further symbol sets by the first and second selectors until one of the selectors wins or one of the selectors loses. The method then includes dispersing to the first player group money bet by the second player group if the first selector wins or the second selector loses, and dispersing to the second player group money bet by the first player group if the first selector loses or the second selector wins. If one of the first or second selectors wins, the method may include replacing the selector that did not win with a player from one of the first or second player groups, and repeating the steps of the method. The method may include further betting by the players between steps of generating symbol sets using the random symbol selector. Except for any players that do not further bet, the players in the first and second layer groups may maintain their same sequence in the further betting.

More preferably, after the betting by the first group of players that the first selector wins or the second selector loses, and the betting by the second group of players that the second selector wins or the first selector loses, the method includes further betting by the players on the first and second selectors.

Typically, the method is practiced by an organizing entity, such as a casino, and further includes dispersing to the organizing entity a portion of the money dispersed to the player groups when a selector wins or loses. Of all symbols capable of being generated by the random symbol generator, at least one symbol is preferably designated as a winning symbol set, at least one symbol is preferably designated as a losing symbol set, and at least one symbol is preferably designated as being neither a winning nor a losing symbol set.

With regard to the bets placed, it is preferred that the method includes segregating each player's amount of money bet from any other player's amount of money bet. There may be provided to each player placing a bet a marker identifying sequence of money bet by such player.

In another aspect, the present invention is directed to a method of playing a dice game with a plurality of players comprising providing at least one die having a plurality of numbers thereon, the at least one die displaying at least one number after being thrown, and designating sets of winning and losing numbers which may be displayed by the die. First shooter and second shooter are selected from the players, and the players are designating into first and second groups. Players in the first group bet amounts of money, in sequence, that the first shooter wins or the second shooter loses, based on the number set displayed by the die. The amount of money bet by each player in the first group is segregated from any other money bet by another player in the first group. Players in the second group bet amounts of money, in sequence, that the second shooter wins or the first shooter loses, based on the number set displayed by the die. Similarly, the amount of money bet by each player in the second group is segregated from any other money bet by another player in the second group. The method also includes providing to each player in the first and second groups placing a bet a marker identifying the sequence of money bet by such player. The first shooter throws the at least one die to display a first number set, and it is determined whether the first shooter wins or loses based on the first number set displayed by the at least one die. If the first shooter wins, the method includes dispersing to the first player group money bet by the second player group, with the money being dispersed to the first player group in the sequence and based on the amount bet by each of the players in the first player group. If the first shooter loses, the method includes dispersing to the second player group money bet by the first player group, the money being dispersed to the second player group in the sequence and based on the amount bet by each of the players in the second player group. If the first shooter neither wins nor loses based on the first number set displayed by the at least one die, the second shooter throws the at least one die to display a second number set, and it is determined whether the second shooter wins or loses based on the second symbol set generated by the random symbol selector. If the second shooter wins, the method includes dispersing to the second player group money bet by the first player group, with the money being dispersed to the second player group in the sequence and based on the amount bet by each of the players in the second player group. If the second shooter loses, the method includes dispersing to the first player group money bet by the second player group, the money being dispersed to the first player group in the sequence and based on the amount bet by each of the players in the first player group. Preferably, if one of the first or second shooters wins, the method includes replacing the shooter that did not win with a player from one of the first or second player groups, and repeating the steps of the method.

The method may provide for further betting by the players between steps of throwing the at least one die. Except for any players that do not further bet, the players in the first and second player groups maintain their same sequence in the further betting. After the betting by the first group of players that the first shooter wins or the second selector loses, and the betting by the second group of players that the second shooter wins or the first selector loses, the method may include further betting by the players on the first and second selectors.

The method is preferably played in a casino, and further includes dispersing to the casino a percentage of the money dispersed to the player groups when a shooter wins or loses. Preferably, a pair of six-sided dice are used, with each side having a different number thereon. A plurality of combinations of numbers displayed by the dice pair are designated as winning numbers, a plurality of combinations of numbers displayed by the dice pair are designated as losing numbers, and a plurality of combinations of numbers displayed by the dice pair being designated as neither winning nor losing numbers.

The present invention, in yet another aspect, is directed to a method of playing a dice game with a plurality of players comprising providing at least one die having a plurality of numbers thereon, the at least one die displaying at least one number after being thrown, and designating sets of winning and losing numbers which may be displayed by the die. Players participating in the dice game are designated into first and second groups. There is provided a gaming table having a flat surface area adapted to receive the die and a perimeter surrounding the flat surface. The table has a plurality of specified locations outside of the table perimeter along which the players may be positioned to place bets, and plurality of separate betting boxes on the table for each of the first and second groups, adapted to receive bets of players. Each of the betting boxes has a sequential number for indicating the sequence of the player's bet for each of the first and second groups. The method includes selecting a first and second shooters from the players. Players in the first group bet amounts of money, in sequence, that the first shooter wins or the second shooter loses, based on the number set displayed by the die. The amount of money bet by each player in the first group is placed in one of the first group's betting boxes having the sequential number corresponding to the sequence of the player's bet, and is segregated from any other money bet by another player in the first group. Players in the second group bet amounts of money, in sequence, that the second shooter wins or the first shooter loses, based on the number set displayed by the die. Similarly, the amount of money bet by each player in the second group is placed in one of the second group's betting boxes having the sequential number corresponding to the sequence of the player's bet, and is segregated from any other money bet by another player in the second group. The method then includes providing to each player in the first and second groups placing a bet a marker identifying the sequence of money bet by such player, with each marker indicating a number corresponding to a sequential number on the betting boxes. The method then continues by the first shooter throwing the at least one die to display a first number set, and determining whether the first shooter wins or loses based on the first number set displayed by the at least one die. If the first shooter wins, the method includes dispersing to the first player group money bet by the second player group, with the money being dispersed to the first player group in the sequence and based on the amount bet by each of the players in the first player group. If the first shooter loses, the method includes dispersing to the second player group money bet by the first player group, with the money being dispersed to the second player group in the sequence and based on the amount bet by each of the players in the second player group. If the first shooter neither wins nor loses based on the first number set displayed by the at least one die, the second shooter throws the at least one die to display a second number set, and determining whether the second shooter wins or loses based on the second symbol set generated by the random symbol selector. If the second shooter wins, the method includes dispersing to the second player group money bet by the first player group, with the money being dispersed to the second player group in the sequence and based on the amount bet by each of the players in the second player group. If the second shooter loses, the method includes dispersing to the first player group money bet by the second player group, with the money being dispersed to the first player group in the sequence and based on the amount bet by each of the players in the first player group.

A further aspect of the present invention is directed to a gaming table system for playing a betting game with a plurality of players and at least one die. The table system which comprises a table having a flat surface area adapted to receive the die and a perimeter surrounding the flat surface, a plurality of specified locations outside of the table perimeter along which the players may be positioned to place bets, and plurality of separate betting boxes on the table, adapted to receive bets of players. Each of the betting boxes having a sequential number for indicating the sequence of the player's bet.

Preferably, the gaming table system further includes a marker to be given to each player placing a bet, with each marker indicating a number corresponding to a sequential number on the betting boxes. The gaming table may include first and second areas, each including the betting boxes, the first area's betting boxes being for the bets on a first shooter chosen from the players and the second area's betting boxes being for the bets on a second shooter chosen from the players Indicator lights may be disposed on the table for showing which of two shooters chosen from the players is in control of the die and which of the two shooters win the game. The gaming table system may further include a read out for displaying a casino percentage of a winning amount of money, and a ridge on the flat surface area for turning the die when the die passes the ridge.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE PREFERRED EMBODIMENT(S)

Figure 1:
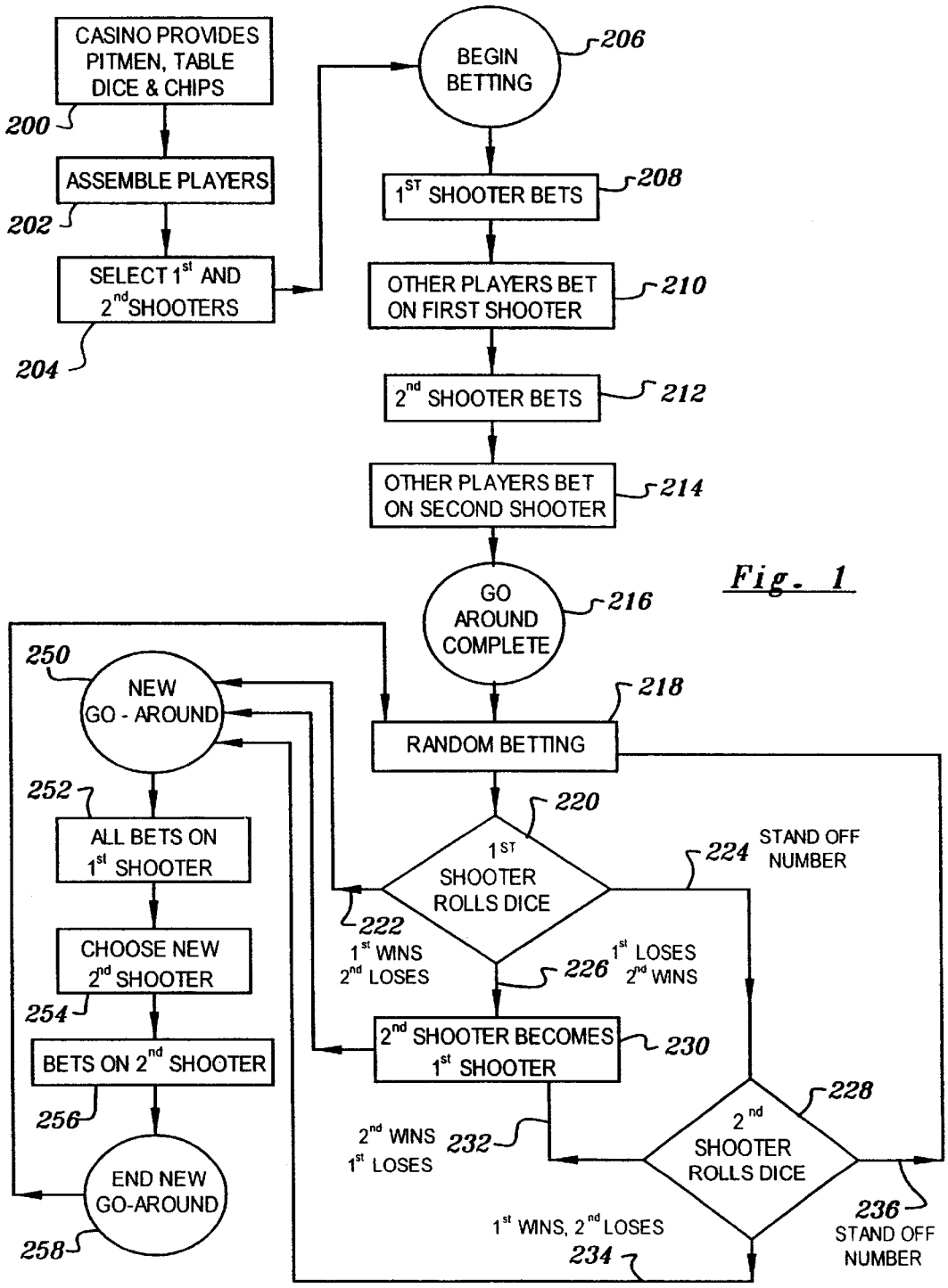
FIG. 1 is a flow chart depicting the betting and shooting steps of the preferred gaming method according to the present invention.

In describing the preferred embodiment of the present invention, reference will be made herein to FIGS. 1–5 of the drawings in which like numerals refer to like features of the invention.

The present invention relates to a method of playing a betting or wagering game, preferably in a casino which involves two primary players who both bet and are actively involved in the game, and a plurality of other players who are additional bettors. The entity organizing the game is alternatively called the house or the casino, and the individuals betting are alternatively called players or bettors. Although a preferred embodiment of the gaming method utilizes the two primary players shooting at least one die, and more preferably a pair of dice, the game may use, in place of the dice, any type of selector which is capable of randomly selecting one or more symbols or indicia which may be pre-designated as winning or losing. Such symbols may be numbers (as in the case of dice), letters or other indicia, and the random symbol selector should be capable of generating a plurality of different such indicia. Before the game begins, one set of such indicia (a "set" comprising one or more of such indicia) is designated as the winning set and another set of such indicia is designated as the losing set. Preferably, the random symbol selector is capable of generating additional indicia which are not part of either the winning or losing sets. The random symbol selector should provide to the primary active players the same odds of generating the sets of winning, losing, or neither winning nor losing indicia. In the case of using dice, these first and second random indicia selectors are called the first and second shooters, respectively. Although the betting game method and system of the present invention will be described with particular reference to the preferred dice game, it may be played with any random symbols.

The two shooters are selected from among a group of players desiring to play the game. The two shooters each bet on themselves to win, while the remaining non-shooting players divide themselves into two groups to bet on the shooters. The players may bet any amount of money on one of the shooters to win. The players may also take positions in each of the two groups, so that they may place a bet on one shooter as a member of one group, and may further place a bet on the other shooter as a member of the other group. There is no necessity that an equal amount of money is bet by the two groups on each of the two shooters; an unequal amount of money may be bet on the each of the two shooters. In playing the betting game of the present invention, the non-shooting players are particularly rewarded by the order in which they decide to bet on the shooter who wins. In other words, the winning players are paid off, in the same amount that they bet, by the losing players, in the identical order in which the winning players placed their bets. If the losing players bet less money than the winning players, the winning players higher in the sequence of betting will be more likely to get paid off with winnings, while those winning players lower in the sequence will be less likely to get paid off, and instead will simply have their bets returned to them. Thus, there is an incentive for players to bet earlier in the sequence of betting for each shooter.

Typically a total of about twenty players will participate, with approximately five individuals organizing and running the game, or "pit men," at one table setting where the game is played. A preferred table is employed, as will be described further below, especially designed to accommodate the betting system of the present invention that permits both shooters to bet any amount that they want, and permits the remaining players to bet any amount that they want on either (or both) of the two shooters. The game can be played in any gambling establishment or house, such as, a casino.

The game is preferably played with two dice or similar random number selector or generation means capable of arbitrary generation of indicia. The indicia may include, for example, numbers, letters, colors, emblems, and the like. In the preferred embodiment, the gaming method of the present invention is played with two (2) dice on a preferred table shown in FIGS. 2 and 5. The dice used in the preferred gaming method are regulation size as used in the game of craps in most of the casinos in the United States, i.e., a cube having six sides numbered 1 to 6. Before the game begins, a set of a combination of numbers or other indicia that may be generated are selected as the winning set, and another set of a combination of numbers or other indicia that may be generated are selected as the losing set. All other numbers or indicia mean nothing, i.e., they neither win nor lose, and are referred to as stand-off numbers. Any number that comes up on the dice that is not a winning or losing number is a stand-off number. When a shooter throws a standoff number, the dice passes to the opposite shooter. The game is preferably played with two shooters. These two shooters are called the first shooter and the second shooter. If the game is continuing, the first shooter is always the one who has just won the last round. All the players can bet on either the first or second shooter, and any player can bet on both shooters to offset his bet. If a first shooter or second shooter decides to pass or quit at any time in the middle of a run, the next person in the betting box taking over as the first or second shooter moves their bet to the front of the betting box. Anyone in rotation refusing to take over the position of the first or second shooter can leave his money in the betting rotation.

An advantage of the game according to the present invention is that each shooter has an equal chance of wining or losing. The first shooter does not have an advantage because the odds are the same for throwing a losing number as well as a winning number. Thus, the game achieves a balance and fairness in being the first or second shooter. The non-shooting player or bettor's chances of winning are also not affected by any strategy in the play of the game, and that the player can win on any of two possibilities—the first player's roll or the second player's roll. The gaming method of the present invention provides in a single game a multiplicity of exciting and pleasurable aspects for both shooting and non-shooting players because all players have a high level of interaction or participation.

A randomly generated jackpot sequence according to the present gaming method has the additional appeal to patrons of a casino of introducing elements of variety, suspense, and a chance to influence the amount of the winning jackpot. The patron may also perceive more fairness in the defined jackpot sequence as neither the host organizing entity nor the players control the sequence which will win a jackpot.

Referring to FIG. 1, a first step 200 of the preferred embodiment of the gaming method starts in a casino which provides a table, pit men, dice, and chips, and assembles a plurality of players 202. To start a new game, the casino picks two players, e.g., from opposite ends of the table, who become the first and second shooters 204. This is done only once at the start of a new game. Each player rolls one die and the high man becomes the first shooter. In subsequent betting, the shooters and the remaining players are designated as being members of a first player group or a second player group, depending on which shooter they bet on to win.

The betting begins, 206, with the first shooter betting any amount of money he wants, 208, on himself to win. Normally, the first shooter will bet on himself to win in the initial round, although in later rounds the first shooter may bet on the second shooter to win to offset or protect any accumulated winnings. This money bet by the first shooter is segregated as the initial bet. Thereafter, in a pre-set direction, e.g., clockwise, from first shooter, players can bet as much as they want on first shooter to win 210. Their bets are segregated in sequence, and all bets are preferably placed into betting boxes marked with the subsequent sequential number of the bet. Each player (including the shooter) is given a marker or identification chip, designating the sequence and box number. This betting is done once around the table, and the players betting on the first shooter to win are designated as the first player group.

The second shooter is then given the opportunity to bet any amount he wants on himself to win, 212. Again, in the same pre-set direction, players can bet any amount on the second shooter in sequence, once around the table, 214. Players betting on the second shooter to win are designated as the second player group. (Betting by a player on both shooters may be done in later rounds to preserve money already won.) These bets on the second shooter are likewise segregated from each other, e.g., in different betting boxes, and identified by sequence by a marker or identification chip to designate the box number. Before the go-around is completed, the first shooter and other betting players can increase/decrease or withdraw part or all monies in the betting box. Once betting on both shooters is completed, a first betting go-around is complete 216, and the bets are then frozen. The amount of money bet on each of the shooters is then totaled.

Once the amount of money bet is determined, betting may then be opened up to random betting 218. If a shooter or other player that has money bet in the first go-around want to bet more, this new bet will be placed in sequence. The money from random betting will also be segregated and go into betting boxes in sequence, and a marker issued, in the same manner as described above, but with the random bet money going in after the money from the first go-around. Therefore, the incentive on the players is to bet early in the betting sequence because money bet later may not be covered. Random betting may continue at any time until the first or second shooter wins the round.

At the actual start of a shooting round, the first shooter rolls the dice for one roll 220. As in any dice game using regulation dice, the numbers at the top of the dice when they come to rest are the randomly selected numbers. Among the various combinations of numbers which can be generated upon throwing the dice, four combinations are pre-selected before the game and designated as the set of winning numbers, e.g., 6/6-6/5-5/5-3/3, and four are pre-selected and designated as the set of losing numbers, e.g., 1/1/-1/2-2/2-4/4. The remaining number combinations are called standoff numbers, which are neither winning nor losing numbers. If the first shooters rolls a winning number combination 222, the first shooter wins and the second shooter automatically loses. On the other hand, if the first shooter rolls a losing number combination 226, the first shooter loses and the second shooter automatically wins. If the number thrown by the first shooter is a standoff number 224, which does not affect a decision, the dice pass to the second shooter who takes one roll 228. If the second shooter rolls a winning number combination 232, the second shooter wins and the first shooter automatically loses. If the second shooter rolls a losing number combination 234, the second shooter loses and the first shooter automatically wins. If the number thrown by the second shooter is a standoff number 236, which does not affect a decision, random betting 218 takes place again, in the same manner as described previously, but with the new money being sequenced after the previous bets, and the dice pass back to the first shooter to continue the shooting round.

If either of the first or second shooter wins in the first shooting round, either by that shooter rolling a combination from the set of winning numbers, or the other shooter rolling a combination from the set of losing numbers, the winnings are determined and dispersed to the winning shooter, as described in detail below in connection with FIG. 2, and a new betting go-around is begun 250.

In the first shooting round, if the first shooter wins by either rolling a winning number combination 222 or by the second shooter rolling a losing number combination 234, the first shooter remains the first shooter in the next betting go-around 250. Alternatively, if the second shooter wins by either rolling a winning number combination 232 or by the first shooter rolling a losing number combination 226, the second shooter moves up to and becomes the first shooter, 230, in the next betting go-around 250. In any event, bets are then placed on the first shooter in the new go-around 252, in the manner described previously in steps 208, 210, and a new second shooter is selected 254 in clockwise rotation from the losing first round shooter. Bets are then placed on the new second shooter 256, in the manner described previously in steps 212, 214.

In the new go around sequence 250, all previous players betting on the first shooter are given first option to stay in their current sequence, or withdraw, and to increase or decrease their bets in step 252. If a player withdraws from the betting sequence, the players in the following sequence of betting positions move up. If a shooter or non-shooting bettor has money in more than one sequence position, or betting box, and a shooter he has bet on wins, on the next betting go-around sequence the bettor can move all his bets to the highest or most forward position he has in the betting sequence. After the new betting go-around ends 258, these bets are frozen and random betting 218 is again permitted. Subsequently, a new shooting round begins with the first shooter rolling the dice 220.

The betting sequence is important to the game. A player can bet on a shooter and be able to stay with the same shooter if the shooter is having a hot run. The non-shooting player makes a decision of how much to bet, and to bet on the first or second shooter. If a shooter quits in the middle of a run, players that are betting on the shooter are asked to take over as the new shooter by sequence or rotation of the number in which they are in the betting box. If all refuse, then it goes to the next player to the left of the shooter that just dropped out, and that new shooter's bet goes to the front of the betting box.

Figure 2:
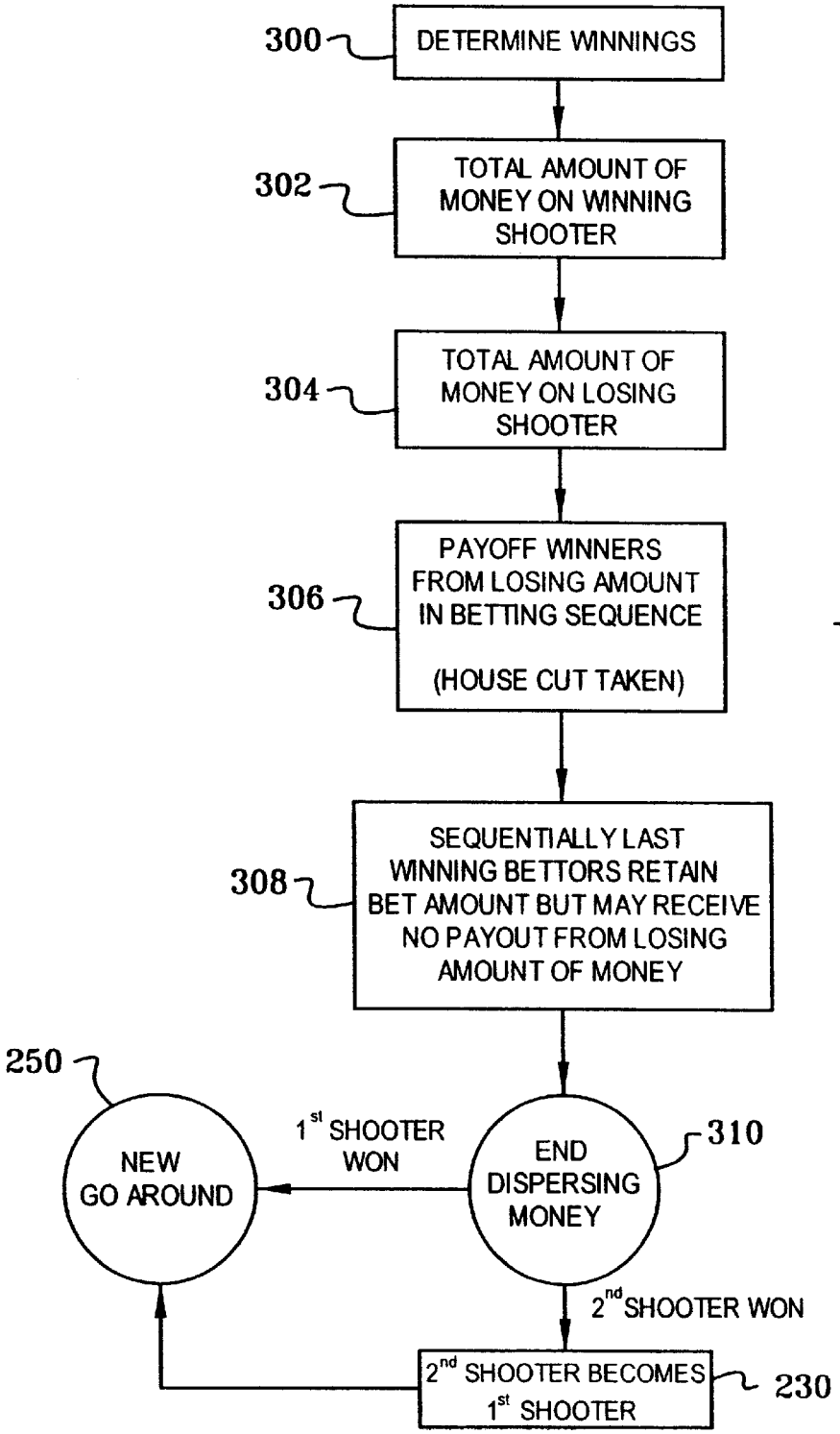
FIG. 2 is a flow chart depicting the betting payoff steps to the winning players of the preferred gaming method according to the present invention.

FIG. 2 shows the sequence of determining the winnings 300 and paying off the winning players. After the first or second shooter wins, the total amount of money bet on the winning shooter is determined, 302, and the total amount of money bet on the losing shooter is determined, 304. The two shooters always occupy the first position in the betting sequence for each player group, and the payoff sequence always starts from this position in betting boxes. The winning players are than paid off in amounts equal to the sequence of bets placed, 306, less any cut given to the house or game organizing entity. The house cut may be, for example, five percent, and is calculated on the losing money only. Preferably, to speed the game along, the house may collect the house cut (percentage of losing money) from the winning player's rack money, which is money in the player's possession (as opposed to his money in the betting box).

The money from the losing player group is dispersed in strict sequential order to the players in the winning player group, until all of the losing player group's money is exhausted. In the event that there is less money bet on the losing shooter than on the winning shooter, the later players who bet on the winning shooter will not be paid off in full, 308. In the event that there is more money bet on the losing shooter than on the winning shooter, the later players who bet on the losing shooter will get the remaining money back, after the players who bet on the winning shooter are fully paid off. After the money is dispersed, 310, if the first shooter won, then the next betting go-around commences, 250 (FIG. 2). If the second shooter won, the second shooter becomes the first shooter, 230, and the then the next betting go-around commences, 250 (FIG. 2).

Figure 3:
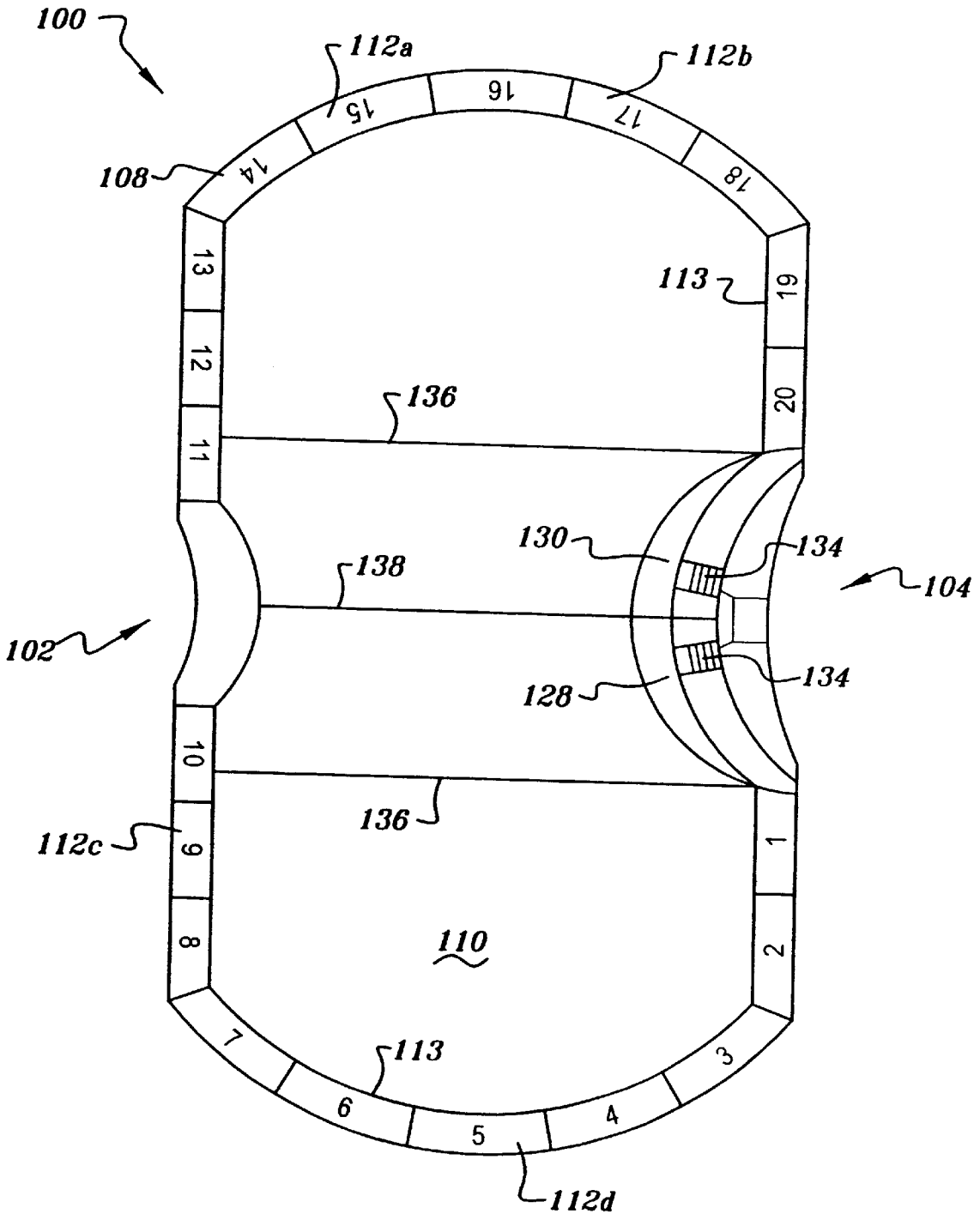
FIG. 3 is a top plan view of a gaming table system utilized in the preferred gaming method of the present invention.
Figure 4:
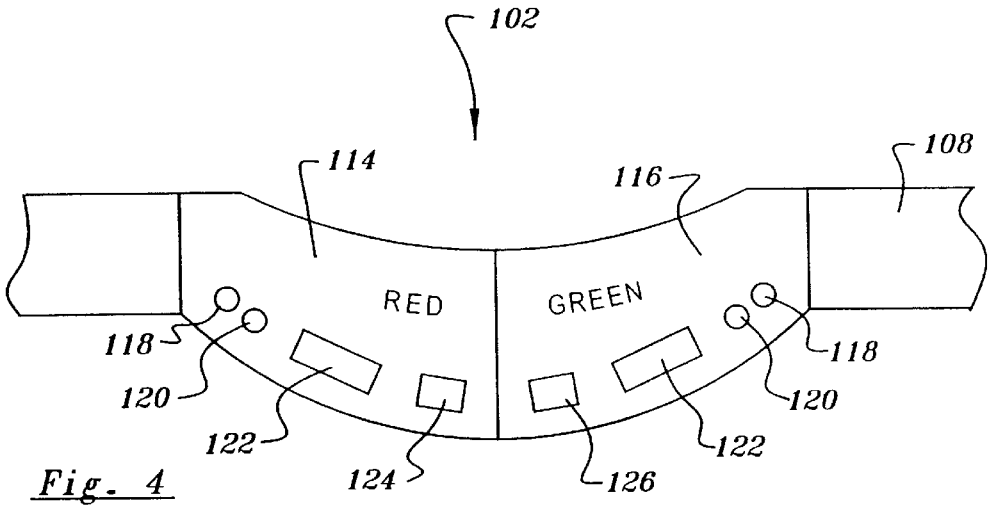
FIG. 4 is a partial plan view of a first side area of the table shown in FIG. 3.
Figure 5:
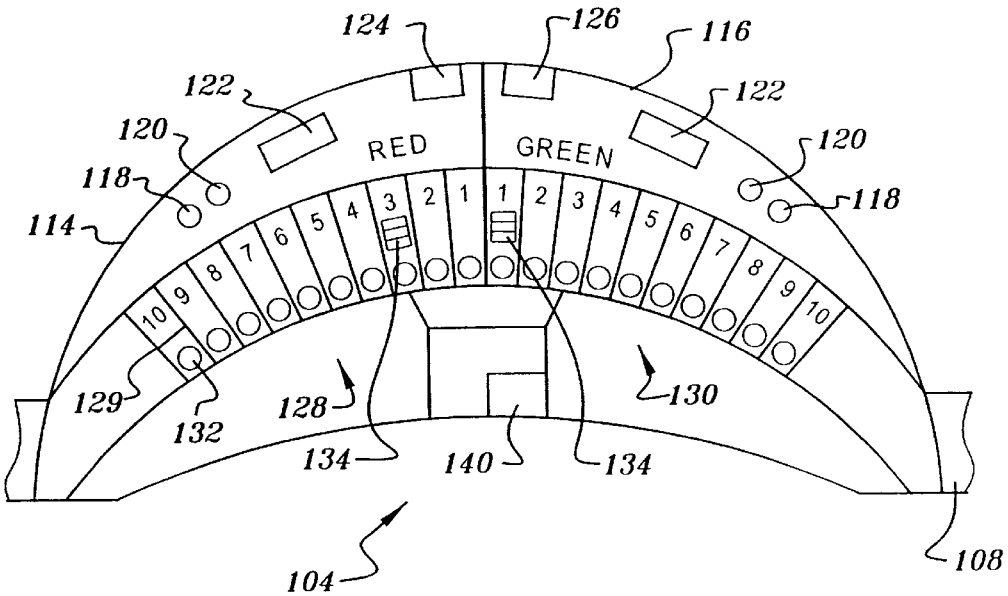
FIG. 5 is a partial plan view of a second area of the table shown in FIG. 4, showing the preferred betting boxes utilized in the gaming method.

The preferred gaming table system of the present invention is depicted in FIGS. 3, 4 and 5. Referring to FIG. 3, a preferred gaming board or table 100 is shown for use with the gaming method described above. The gaming board 100 includes a substantially flat central surface area 110 extending along the length of the tabletop. Along the perimeter 108 of the table there is a first area 102 and a second area 104 for the casino employees organizing and running the game. The remaining perimeter is for the players, who stand (or sit) at positions that are numbered. These position numbers are merely for convenience and are independent of the betting sequence described herein. The individual positions 112*a*, 112*b*, 112*c*, 112*d* have banking along the inner sides 113 so that dice may bounce off.

The first area 102, shown in more detail in FIG. 4, is provided for a stick man who handles the dice and a light man who controls the lights and other indicators, described below, while a second area 104, shown in more detail in FIG. 5, is provided for two bank men who handle the money being bet and dispersed. The first area 102 includes different color indicia, such as red side 114 and green side 116, respectively corresponding to one or the other of the first and second shooters. The color for a particular shooter stays the same for each shooting round. Instead of moving the winning players' money, an indicator light (described further below) designates the position of the shooter.

First area 301, shown in more detail in FIG. 7, also includes on each of the red and green sides indicator lights 118, 120, indicating which of the first shooter or second shooter is represented by that color, a house compensation indicator or read out 122, indicating the house's cut of the losing bets; and win indicator lights 124, 126, indicating which of the shooters won the shooting round. The advantage of displaying the house compensation is that the players can easily and readily view the house's cut of their winnings, which greatly assists the players in understanding the game The second area 104, shown in more detail in FIG. 5, also includes a red side 114 and a green side 116, and the same indicator lights described for first area 102. The indicators of the first and second sides are preferably positioned so that players at any position around table 100 have a view of at least one of each indicator. Second area 104 also includes betting boxes 128, 130, on the red and green sides, for those betting on the first and second shooter, respectively. Each individual betting box on each of the red and green sides is sequentially numbered (1–10 as shown in FIG. 5) and comprises a slot for chips or other articles representing the money bet by each player. It is more preferred that there be at least eighteen betting boxes on each side of the table, and these can be one-half the size of the boxes shown in FIG. 5. Each betting box is preferably open at the side facing the bank men so that the bets may be easily handled, but is separated by a wall 129 from an adjacent box, so that the contents are securely segregated from all other boxes. Initially, each betting box contains a marker 132, which is colored to correspond to the side of the table and numbered to correspond to the individual box on that side of the table. These markers are provided to the players to indicate which betting box contains their individual bets. The individual positions 112*a*, 112*b*, 112*c*, 112*d* preferably include chip racks for holding the marker or identification chip for the betting box.

The purpose for indicator lights 118, 120 is to indicate which color side, red or green, corresponds to which shooter area. For example, the bets on the first shooter may be on the green side, and the bets on the second shooter bets may be on the red side. If the second shooter wins, and thereby moves up to be the first shooter in the next betting go-around, the house does not have to move his money and the other players' money betting on him from one side of table to the other. If the first and second shooters' sides of the table were permanent, all of the second shooter's money plus everyone betting on the second shooter would have to be moved to the opposite side of the table. This would wastes time and causes confusion. The use of lights to indicate the shooter represented on a particular side speeds up the playing of the game, and greatly reduced disputes over the money bet.

Referring back to FIG. 3, table 100 also includes two ridges 136 extending upwards from the table surface and across the width of the table. The shooters preferably stand at the opposing right and left ends of the table when shooting or rolling the dice. The ridges 136 function to ensure that the dice tumble to display a number randomly, thereby preventing a player from locking one die in his small finger and sliding it with a spin. Without a ridge in the table 300, a nefarious player can lock a die on a particular number on the up side, making it impossible for him to throw a losing number. The ridges in the table 300 preventing such a trick as the shooter rolls the dice from one end of the table to the other across the center line 138.

The table further includes a calculator 140 for quickly calculating the house cut or winnings, and displaying them using the readout 122. This permits the players and the house people to know that the correct amount is paid by the winning players from their rack money.

Preferably, all bets are in increments conducive to the table's minimum bet to facilitate the game moving rapidly. For example, the game may be played at one table with bets in the range of $1–$99, at $1 increments, at another table with bets at $5 increments and a $10 or higher minimums (e.g., $10, $25, $50 and so on), at another table with bets at $25 increments, with a $100 minimums, and so on. All tables preferably have a minimum bet, but more preferably no table has a maximum limit.

As an example of playing the preferred dice game of the present invention, the first and second shooter are selected by the house, and the red side is designated as the side for bets on the first shooter, so that lights 118 are lit on the red side of the table. The green side is designated as the side for bets on the second shooter, and lights 120 are lit on the green side of the table. Betting on the first shooter to win, the first shooter bets $100, and moving clockwise around the table from him, the first non-shooting bettor bets $200, and the next bettor bets $500, with no further bets being made. This ends the first go-around betting on first shooter, who has bets totaling $800 on him to win. Since the first shooter is designated on the red side of the table, the bets of $100, $200 and $500 are placed sequentially in red side betting boxes 128 marked 1, 2 and 3, respectively, and markers 132 are given to each of the three players betting on the first shooter to indicate which of the red betting boxes contains their money. Betting on the second shooter to win, the second shooter then bets $300, and continuing clockwise, the next bettor bets $300, and another bets $500, with no more bets being made, thus ending the go-around on the second shooter. The second shooter has bets of $300, $300, and $500, for a total of $1100. These bets are placed separately and sequentially into betting boxes 130 marked 1, 2 and 3, respectively, on the green side of the table. Thus, there is a total of $800 bet on first shooter, and $1100 on the second shooter, leaving $300 open and uncovered on the first shooter, i.e., an excess of $300 bet on the second shooter. This money now is in the frozen zone and the first betting go-around ends.

Next, any player is given an opportunity to bet randomly. Continuing with the example, another bettor bets $500 on the first shooter, and his money goes into the box marked 4 of the red box area 128, so that the total amount bet now equals $1300. Two more bettors bet on the second shooter in amounts of $100 and $200, which are placed in boxes marked 4 and 5 on the green side, respectively, after which the betting stops. The total bet on the second shooter is now $1400, which means that $100 of the bets on the second shooter is uncovered because only $1300 was bet on the first shooter.

The shooters then roll the dice in sequence, as described previously, to see who wins.

In the subsequent shooting round, if the first shooter wins, then the red side wins, and the green side pays-off. Each of the players who bet on the first shooter wins from the green side an amount equal to the amount that they bet, minus a percentage which goes to the house. Using an example of a 5% house cut, the house receives from the losing bettors 5% of $1300 of the losing bets, to cover the $1300 bet on the first shooter to win. The house distributes from the losing bets to the four players who bet on the first shooter $100, $200, $500 and $500, respectively, in addition to the winning players keeping the money that they originally bet. Preferably, the house will collect the 5% of the losing bets, $5, $10, $25 and $25, respectively, from the winning players' rack money. All of the players betting on the second shooter lose, except the fifth bettor (green box marked 5), since only $100 of his $200 was covered. This fifth bettor gets $100 back with no cut to the house. Since the first shooter won, he remains in the first shooter position and the money to be bet on him stays on the red side, so that light 118 remains lit on the red side and light 120 remains lit on the green side.

If, instead, the second shooter wins the shooting round, the green side wins and the red side pays-off, so that each of the players who bet on the second shooter wins from the red side an amount equal to the amount that they bet, minus a percentage of the losing bets which goes to the house. Preferably, the green side players pay the house from their rack money, in manner analogous to that previously described. The one exception is the fifth bettor on the green side, who receives only winnings based on $100 of his $200 bet. Because he was the last bettor, the $100 of the total bet on the second shooter that was not covered by bets on the first shooter is applied to his bet. Thus, the net payoffs to the winning green side players who bet on the second shooter are $285, $285, $475, $95 and $95, respectively. Since the second shooter won, he moves up into the position of the first shooter, and the money to be bet on him stays on the green side, with light 118 designating the first shooter now being lit on the green side, and light 120 being lit on the red side to designate the second shooter.

In either winning scenario, the players betting on the winning shooter then have the option of placing bets on the same shooter, who is the first shooter for the next go-around, and remain in their same betting sequence. The players are asked their betting preference, wherein the bets may be maintained, increased, decreased or withdrawn, as the played desires. If a player drops out from betting on the winning shooter, the lower positioned bettors move up. If a player who had bet on the winning shooter has more than one position in the betting boxes, for example by having placed bets in both the go-around and the random betting, that player may move all bets up to his most forward, i.e., lowest numbered, betting box.

A run occurs when two or more consecutive shooting rounds are won by the same shooter. If the second shooter quits in a run, the next player in sequence takes over his position, to maintain any runs in progress. If the second place player refuses to take over as shooter, the next bettor in line moves to the first position, and may also moves his bet into first position in the betting box. The first and second shooters always occupy box 1 in betting sequence on their respective sides of the table.

The preferred game of the present invention may have the following additional rules:

1. The marker or identification chip for the betting box must always remain in the chip rack when held by players.
2. Players who have just lost a round give up their identification chip only after payoff is made. Also, any player that bet on the winner and takes all of his bet out of the game must give up his identification chip.
3. The shooters may shoot the dice out of the cup when there are no bumps or ridges in the table, or it can be made mandatory that both dice must hit the banking around the table.
4. The game is played with regular crap dice having sides marked 1, 2, 3, 4, 5 and 6, and both dice must go over center line and hit the table banking.
5. Both dice must be on table surface and lie flat after the roll is completed, so that the displayed numbers face upwards.
6. All players can bet on either shooter or both shooters.
7. The start of a new game is determined by the casino.
8. At the start of a new game, the casino picks two (2) players from the opposite ends of the table.
9. The first shooter is picked by two random players shooting one dice. The highest number rolled will become the first shooter.
10. After the game starts the shooters are always picked by clockwise rotation from the losing shooter.
11. On go-around betting, bets and payoff are always made in sequence of the number the player has in the betting box and not where the player is standing at the table.
12. All tables have minimum bets, no maximum bets, and all bets must meet minimum bet and increment of table.
13. Once a round starts, no shooter or bettor can call off the bet.
14. Any bettor in sequence can refuse to become a shooter and not give up his place in betting box in a normal play. However, if the first or second shooter gives up the dice in the middle of a run, those shooters must remove their bet from the first box in the betting sequence. The shooter giving up his first position can bet on either shooter or not, in the random betting sequence.
15. Special and regular chips are used to pay and make change for winning bettors.
16. All winning bettors must pay off the house cut from their rack money. After the payoffs, winning bettors can reduce or increase the size of their bet as long as they do it in the increment of the table at which they are playing.

It is an important feature of the present invention to permit a bettor to select which of two shooters he thinks will win, and to wager and receive winnings based on the order in which that bettor places his bet. The present invention also provides a jackpot comprising the total of the money bet on the losing shooter. The jackpot is particularly attractive to players as a large payoff available as part of a basic wager. The mere possibility of the jackpot acts as a lodestone to attract players and maintain their interest in the game. Unlike the game of craps, the game of the present invention does not have any odds that favor one player over another. According to the preferred gaming method of the present invention, the casino or entity organizing the game does not participate in the betting, and may receive its share from the losing bets.

When a winning player is established, all monies bet on him will always remain in the same sequence. Winning bettors are paid off in the order that they made their bets from the losing bets. The probability is high that all bettors' monies will not be covered during and at the end of a round of shooting. Although equal amount of money bet on both shooters is possible, the game typically lends itself to an unequal betting pool because a player will make the most money playing the game when he lets his bet ride or keeps betting on a winning player. As a result, the shooter may bet a minimal amount of money and a bettor may bet a large amount of money on the shooter, leading to uncovered bets. The gaming method of the present invention protects a large bettor's money and keeps their bet covered by protecting the bettors place in the line of betting. The higher in the sequence a bettor is, the higher are the chances his bet will be covered when using the betting sequence of the present invention. In contradistinction, the lower in sequence a bettor is, the lower are his chances that his bet will be covered. Excess or uncovered monies bet may be advertised by the house, since it is the house's objective it to get players to keep betting, and to encourage the most money possible to be bet on both shooters. Further, any player can bet at his own comfort level, with small bettors participating with larger bettors.

The casino preferably does not participate in the betting. The casino's interest in the game is to make sure all betting and procedures are kept and all rules of pay are met. The casino may have people interested in playing sign up at a courtesy desk, and when the casino has a sufficient number of people waiting, it may open a new table. In the interim, if casino has games in progress, it may insert new players into any open position at existing tables. Alternatively, the casino can leave betting boxes empty if a shooter or bettor pulls money out of the betting box, thereby maintaining a high speed of betting by avoiding moving the other bettors forward unless more room is needed for more people betting.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A method of playing a betting game with a plurality of players comprising:

providing a random symbol selector adapted to generate different symbols;

designating sets of winning and losing symbols which may be generated by the random symbol selector;

selecting a first selector from the players;

designating players into first and second groups;

betting amounts of money in sequence, by players in the first group, in favor of the first selector winning, based on a symbol set generated by the random symbol selector;

betting amounts of money in sequence, by players in the second group, against the first selector winning based on a symbol set generated by the random symbol selector;

generating a first symbol set, by the first selector, using the random symbol selector;

determining whether the first selector wins or loses based on the first symbol set generated by the random symbol selector, a symbol set from the designated set of winning symbols indicating that the first selector wins and a symbol set from the designated set of losing symbols indicating that the first selector loses;

if the first selector wins, dispersing to the first player group money bet by the second player group, the money being dispersed to the first player group in the sequence and based on the amount bet by each of the players in the first player group;

if the first selector loses, dispersing to the second player group money bet by the first player group, the money being dispersed to the second player group in the sequence and based on the amount bet by each of the players in the second player group.

2. The method of claim 1 including designating a second selector from the players, wherein the betting by the first group of players is that the first selector wins or the second selector loses, and the betting by the second group of players is that the second selector wins or the first selector loses, and if the first selector neither wins nor loses based on the first symbol set generated by the random symbol selector, further comprising:

generating a second symbol set, by the second selector, using the random symbol selector;

determining whether the second selector wins or loses based on the second symbol set generated by the random symbol selector, a symbol set from the designated set of winning symbols indicating that the second selector wins and a symbol set from the designated set of losing symbols indicating that the second selector loses;

if the second selector wins, dispersing to the second player group money bet by the first player group, the money being dispersed to the second player group in the sequence and based on the amount bet by each of the players in the second player group;

if the second selector loses, dispersing to the first player group money bet by the second player group, the money being dispersed to the first player group in the sequence and based on the amount bet by each of the players in the first player group.

3. The method of claim 2 wherein, if the first selector neither wins nor loses based on the first symbol set generated by the random symbol selector, and if the second selector neither wins nor loses based on the second symbol set generated by the random symbol selector, further comprising alternately generating further symbol sets by the first and second selectors until one of the selectors wins or one of the selectors loses, and dispersing to the first player group money bet by the second player group if the first selector wins or the second selector loses, and dispersing to the second player group money bet by the first player group if the first selector loses or the second selector wins.

4. The method of claim 3 further comprising, if one of the first or second selectors wins, replacing the selector that did not win with a player from one of the first or second player groups, and repeating the steps of the method.

5. The method of claim 3 including further betting by the players between steps of generating symbol sets using the random symbol selector.

6. The method of claim 5 wherein, except for any players that do not further bet, the players in the first and second player groups maintain their same sequence in the further betting.

7. The method of claim 2 including, after the betting by the first group of players that the first selector wins or the second selector loses, and the betting by the second group of players that the second selector wins or the first selector loses, further betting by the players on the first and second selectors.

8. The method of claim 1 wherein the method is practiced by an organizing entity, and further including dispersing to the organizing entity a portion of the money dispersed to the player groups when a selector wins or loses.

9. The method of claim 1 wherein, of all symbols capable of being generated by the random symbol generator, at least one symbol is designated as a winning symbol set, at least one symbol is designated as a losing symbol set, and at least one symbol is designated as being neither a winning nor a losing symbol set.

10. The method of claim 1 further comprising segregating each player's amount of money bet from any other player's amount of money bet.

11. The method of claim 10 further comprising providing to each player placing a bet a marker identifying sequence of money bet by such player.

12. A method of playing a dice game with a plurality of players comprising:

providing at least one die having a plurality of numbers thereon, the at least one die displaying at least one number after being thrown;

designating sets of winning and losing numbers which may be displayed by the die;

selecting a first shooter from the players;

selecting a second shooter from the players;

designating players into first and second groups;

betting amounts of money in sequence, by players in the first group, that the first shooter wins or the second shooter loses, based on the number set displayed by the die, the amount of money bet by each player in the first group being segregated from any other money bet by another player in the first group;

betting amounts of money in sequence, by players in the second group, that the second shooter wins or the first shooter loses, based on the number set displayed by the die, the amount of money bet by each player in the second group being segregated from any other money bet by another player in the second group;

providing to each player in the first and second groups placing a bet a marker identifying the sequence of money bet by such player;

throwing the at least one die, by the first shooter, to display a first number set;

determining whether the first shooter wins or loses based on the first number set displayed by the at least one die;

if the first shooter wins, dispersing to the first player group money bet by the second player group, the money being dispersed to the first player group in the sequence and based on the amount bet by each of the players in the first player group;

if the first shooter loses, dispersing to the second player group money bet by the first player group, the money being dispersed to the second player group in the sequence and based on the amount bet by each of the players in the second player group;

if the first shooter neither wins nor loses based on the first number set displayed by the at least one die, throwing the at least one die, by the second shooter, to display a second number set;

determining whether the second shooter wins or loses based on the second symbol set generated by the random symbol selector;

if the second shooter wins, dispersing to the second player group money bet by the first player group, the money being dispersed to the second player group in the sequence and based on the amount bet by each of the players in the second player group;

if the second shooter loses, dispersing to the first player group money bet by the second player group, the money being dispersed to the first player group in the sequence and based on the amount bet by each of the players in the first player group.

13. The method of claim 12 further comprising, if one of the first or second shooters wins, replacing the shooter that did not win with a player from one of the first or second player groups, and repeating the steps of the method.

14. The method of claim 12 including further betting by the players between steps of throwing the at least one die and wherein, except for any players that do not further bet, the players in the first and second player groups maintaining their same sequence in the further betting.

15. The method of claim 12 including, after the betting by the first group of players that the first shooter wins or the second selector loses, and the betting by the second group of players that the second shooter wins or the first selector loses, further betting by the players on the first and second selectors.

16. The method of claim 1 wherein the method is played in a casino, and further including dispersing to the casino a percentage of the money dispersed to the player groups when a shooter wins or loses.

17. The method of claim 12 wherein a pair of six-sided dice are used, each side having a different number thereon, and wherein a plurality of combinations of numbers displayed by the dice pair are designated as winning numbers, a plurality of combinations of numbers displayed by the dice pair are designated as losing numbers, and a plurality of combinations of numbers displayed by the dice pair being designated as neither winning nor losing numbers.

18. A method of playing a dice game with a plurality of players comprising:

providing at least one die having a plurality of numbers thereon, the at least one die displaying at least one number after being thrown;

designating sets of winning and losing numbers which may be displayed by the die;

designating players into first and second groups;

providing a gaming table having a flat surface area adapted to receive the die and a perimeter surrounding the flat surface, a plurality of specified locations outside of the table perimeter along which the players may be positioned to place bets, and plurality of separate betting boxes on the table for each of the first and second groups adapted to receive bets of players, each of the betting boxes having a sequential number for indicating the sequence of the player's bet for each of the first and second groups;

selecting a first shooter from the players;

selecting a second shooter from the players;

betting amounts of money in sequence, by players in the first group, that the first shooter wins or the second shooter loses, based on the number set displayed by the die, the amount of money bet by each player in the first group being placed in one of the first group's betting boxes having the sequential number corresponding to the sequence of the player's bet and segregated from any other money bet by another player in the first group;

betting amounts of money in sequence, by players in the second group, that the second shooter wins or the first shooter loses, based on the number set displayed by the die, the amount of money bet by each player in the second group being placed in one of the second group's betting boxes having the sequential number corresponding to the sequence of the player's bet and segregated from any other money bet by another player in the second group;

providing to each player in the first and second groups placing a bet a marker identifying the sequence of money bet by such player, each marker indicating a number corresponding to a sequential number on the betting boxes;

throwing the at least one die, by the first shooter, to display a first number set;

determining whether the first shooter wins or loses based on the first number set displayed by the at least one die;

if the first shooter wins, dispersing to the first player group money bet by the second player group, the money being dispersed to the first player group in the sequence and based on the amount bet by each of the players in the first player group;

if the first shooter loses, dispersing to the second player group money bet by the first player group, the money being dispersed to the second player group in the sequence and based on the amount bet by each of the players in the second player group;

if the first shooter neither wins nor loses based on the first number set displayed by the at least one die, throwing the at least one die, by the second shooter, to display a second number set;

determining whether the second shooter wins or loses based on the second symbol set generated by the random symbol selector;

if the second shooter wins, dispersing to the second player group money bet by the first player group, the money being dispersed to the second player group in the sequence and based on the amount bet by each of the players in the second player group;

if the second shooter loses, dispersing to the first player group money bet by the second player group, the money being dispersed to the first player group in the sequence and based on the amount bet by each of the players in the first player group.

19. A gaming table system for playing a betting game with a plurality of players, which comprises:

at least one die;

a table having a flat surface area adapted to receive the die and a perimeter surrounding the flat surface;

a plurality of specified locations outside of the table perimeter along which the players may be positioned to place bets;

plurality of separate betting boxes on the table adapted to receive bets of players, each of the betting boxes having a sequential number for indicating the sequence of the player's bet;

a plurality of markers to be given to players placing a bet, each marker having indicia thereon for indicating a number corresponding to a sequential number on the betting boxes; and a plurality of chips representing money bet by each player.

20. The gaming table system of claim 19 including first and second areas each including the betting boxes, the first area's betting boxes being for the bets on a first shooter chosen from the players and the second area's betting boxes being for the bets on a second shooter chosen from the players.

21. The gaming table system of claim 19 further including indicator lights for showing which of two shooters chosen from the players is in control of the die and which of the two shooters win the game.

22. The gaming table system of claim 19 further including a read out for displaying a casino percentage of a winning amount of money.

23. The gaming table system of claim 19 further including a ridge on the flat surface area for turning the die when the die passes the ridge.

* * * * *

UNITED STATES PATENT AND TRADEMARK OFFICE

CERTIFICATE OF CORRECTION

PATENT NO. : 6,612,579 B1
DATED : September 2, 2003
INVENTOR(S) : John Cembruch

It is certified that error appears in the above-identified patent and that said Letters Patent is hereby corrected as shown below:

Column 1,
Line 21, delete “skilled” and substitute therefor -- skill --.

Column 11,
Line 60, after “articles” insert therefor -- 134 --.
Line 61, after “player” insert therefor -- (see also Fig. 3) --.

Column 12,
Line 20, delete “would”.
Line 23, delete “reduced” and insert therefor -- reduces --.

Column 14,
Line 7, delete “played” and insert therefor -- player --.
Line 18, delete “may”.

Column 15,
Line 35, delete “it” (second occurrence).

Signed and Sealed this

Second Day of December, 2003

JAMES E. ROGAN
*Director of the United States Patent and Trademark Office*